US009881580B2

(12) United States Patent
Chen et al.

(10) Patent No.: US 9,881,580 B2
(45) Date of Patent: Jan. 30, 2018

(54) CIRCUIT FOR COMMON ELECTRODE VOLTAGE GENERATION

(71) Applicant: Solomon Systech Limited, Hong Kong (HK)

(72) Inventors: Zhirong Chen, Hong Kong (HK); Wing Chun Chan, Hong Kong (HK); Wai Kwong Lee, Hong Kong (HK); Choi Wing Siu, Hong Kong (HK)

(73) Assignee: Solomon Systech Limited, Hong Kong (HK)

( * ) Notice: Subject to any disclaimer, the term of this patent is extended or adjusted under 35 U.S.C. 154(b) by 232 days.

(21) Appl. No.: 14/887,319

(22) Filed: Oct. 19, 2015

(65) Prior Publication Data

US 2017/0103724 A1 Apr. 13, 2017

(30) Foreign Application Priority Data

Oct. 10, 2015 (CN) ..... 2015 1 0649043

(51) Int. Cl.
*G09G 3/36* (2006.01)
*G09G 3/34* (2006.01)

(52) U.S. Cl.
CPC ..... *G09G 3/3696* (2013.01); *G09G 3/3655* (2013.01); *G09G 3/344* (2013.01); *G09G 3/3677* (2013.01); *G09G 2300/0809* (2013.01); *G09G 2310/0291* (2013.01); *G09G 2310/068* (2013.01)

(58) Field of Classification Search
CPC ..... G09G 3/3655; G09G 3/3696; G09G 2310/0297; G09G 3/3614; G09G 2330/02; G09G 2310/0291; G06F 3/0412; G06F 3/0416; G06F 3/044; G06F 3/0418; G06F 2203/04112; G06F 1/3218; G06F 2203/04104; G06F 3/03545; G06F 3/041; G06F 3/0414
See application file for complete search history.

(56) References Cited

U.S. PATENT DOCUMENTS

| | | | | |
|---|---|---|---|---|
| 7,880,708 | B2 | 2/2011 | Chen | |
| 2004/0263446 | A1* | 12/2004 | Kawase | G09G 3/3655 345/87 |
| 2007/0013631 | A1 | 1/2007 | Yang | |
| 2008/0316154 | A1 | 12/2008 | Kim | |
| 2010/0182292 | A1* | 7/2010 | Kouno | G09G 3/3655 345/205 |
| 2012/0218250 | A1 | 8/2012 | Pei et al. | |

* cited by examiner

*Primary Examiner* — Duc Dinh

(57) ABSTRACT

A circuit for common electrode voltage generation includes: a VCOM driver configured to output alternating voltage levels at an output thereof, the output being connected to a display panel; a switching circuit with a plurality of inputs and an output, being configured to select one of voltage levels at the inputs at a time and thereby to output alternating voltages levels at the output of the switching circuit; and a stabilizing capacitor with one end connected to the output of the VCOM driver, and the other end connected to the output of the switching circuit.

16 Claims, 6 Drawing Sheets

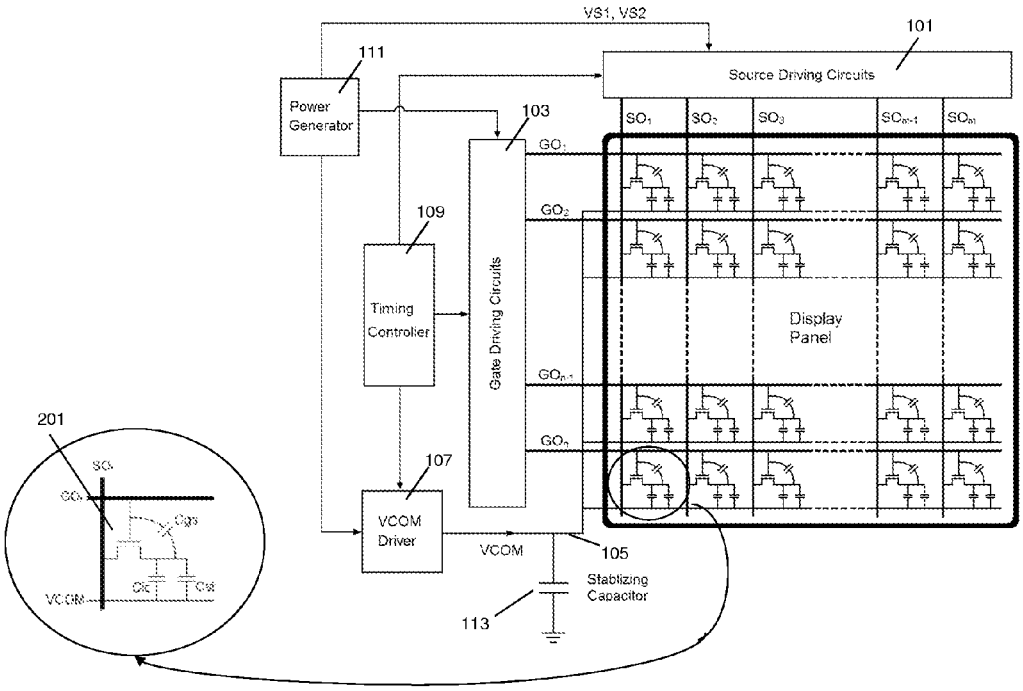
FIG. 2 (Prior Art)
FIG. 1 (Prior Art)
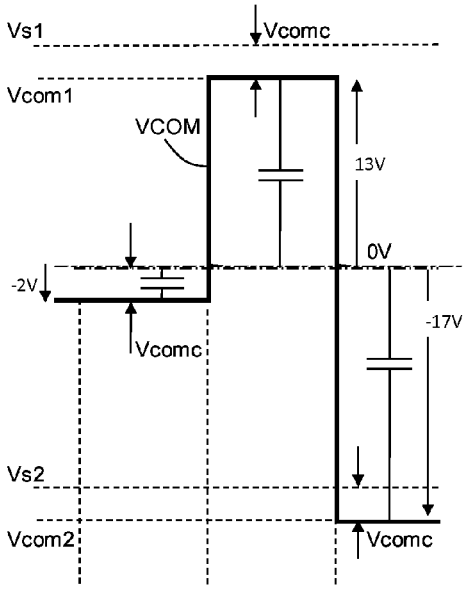
FIG. 3 (Prior Art)

CIRCUIT FOR COMMON ELECTRODE VOLTAGE GENERATION

FIELD OF THE PATENT APPLICATION

The present patent application generally relates to electronic display devices and more specifically to a circuit for generating voltage for common electrode (VCOM) of a display panel.

BACKGROUND

A typical active matrix display panel system, of various display technologies such as LCD, ePaper, and electrophoretic display, is shown in FIG. 1. Referring to FIG. 1, source lines SO1, SO2, . . . , SOm−1, SOm are driven by source driving circuits 101. Gate lines GO1, GO2, . . . , GOn−1, GOn are driven by gate driving circuits 103. A common electrode (VCOM) 105 of all pixels are connected, and is driven by VCOM driving circuits 107. A timing controller 109 provides timing control signals for the source driving circuits 101, the gate driving circuits 103 and the VCOM driving circuits 107. A power generator 111 provides DC power for the above mentioned circuits. For example, DC power of VS1 and VS2 are provided by the power generator 111 to the source driving circuits 101, which outputs voltage levels of Vs1 and Vs2 to source lines.

Referring to FIG. 1, the VCOM driving circuits 107 include a VCOM Driver, which is a voltage driving circuit with its output connected to the VCOM electrode 105 of the display panel. One large stabilizing capacitor 113 is connected between the VCOM electrode 105 and the ground. This capacitor is configured to reduce the noise on the VCOM electrode 105 during the display period. The display panel can be modeled as a capacitor connected between the VCOM electrode 105 and the ground.

FIG. 2 is schematic diagram of one display pixel of the display panel depicted in FIG. 1. Referring to FIG. 2, the display pixel includes a switch element 201, such as a thin film transistor (TFT); a storage capacitor Cst; a pixel display element, modelled by a capacitor Clc; and parasitic capacitance, modelled by a capacitor Cgs. The gate and drain electrodes of the TFT 201 are connected to one gate line GOi, and one source line SOj of the display panel respectively. The source electrode of the TFT 201 is connected to the Clc and the Cst. The other terminal of Clc and Cst are connected to a VCOM electrode of display panel.

There are two conventional methods for driving display panels: the DC-VCOM method and the AC-VCOM method. The resultant voltages across 3 terminals (GOi, SOj, VCOM) of a pixel are the same in both method, which conform to the panel driving requirement. With the DC-VCOM Method, the VCOM voltage remains at a constant level of Vcomc, so is the voltage across the stabilizing capacitor 113 (as shown in FIG. 1). With the AC-VCOM Method, the VCOM voltage alternates, so that the driving voltage levels of source and gate voltages can be reduced. Alternatively, instead of reducing driving voltage levels, the resultant pixel voltages can be increased without increasing the driving voltage levels. With this method, the VCOM driver keeps charging and discharging the stabilizing capacitor 113, thereby consuming a considerable amount of power. FIG. 3 shows a waveform of VCOM voltage in the AC-VCOM method. Referring to FIG. 3, as the VCOM voltage alternates between Vcomc (−2V), Vcom1 (13V) and Vcom2 (−17V), the voltage across the stabilizing capacitor 113 (as shown in FIG. 1) alternates between −2V, 13V and −17V.

The voltage variation across the stabilizing capacitor is relatively large. The voltage and capacitance figures are illustrative. Different display panels may have different driving voltage level requirements, and feature different capacitance characteristics.

SUMMARY

The present patent application is directed to a circuit for common electrode voltage generation. In one aspect, the circuit includes: a VCOM driver configured to output alternating voltage levels at an output thereof, the output being connected to a display panel; a switching circuit with three inputs and an output, being configured to select one of voltage levels at the inputs at a time and thereby to output alternating voltages levels at the output of the switching circuit; and a stabilizing capacitor with one end connected to the output of the VCOM driver, and the other end connected to the output of the switching circuit. The switching circuit is configured to output voltage levels of 0, Vs1, and Vs2, where Vs2=−Vs1. The VCOM driver is configured to output three alternating voltage levels Vcomc, Vcom1 and Vcom2 at the output thereof, where Vcom1=Vs1+Vcomc, Vcom2=Vs2+Vcomc, or to output two alternating states: Vcomc voltage level and high impedance state.

The switching circuit may include three MOS switches, source or drain of the three MOS switches being respectively connected to ground, power source of the voltage level Vs1, and power source of the voltage level Vs2; drain or source of the MOS switches being connected to the output of the switching circuit.

The VCOM driver may include three MOS switches, a first operational amplifier, and a second operational amplifier, source or drain of the three MOS switches being respectively connected to ground, power source of the voltage level Vs1, and power source of the voltage level Vs2; the drain or source of the three MOS switches being connected to an input of the second operational amplifier through a first resistor. The first operational amplifier may be configured to output the voltage level Vcomc and the output of the first operational amplifier may be connected to the input of the second operational amplifier through a second resistor. The circuit may further include a MOS switch, source or drain of the MOS switch being connected to an output of the second operational amplifier; drain or source of the MOS switch being connected to the stabilizing capacitor.

The VCOM driver may include a first operational amplifier configured to output the voltage level Vcomc and a MOS switch, source or drain of the MOS switch being connected to an output of the first operational amplifier; drain or source of the MOS switch being connected to the stabilizing capacitor.

In another aspect, the present patent application provides a circuit for common electrode voltage generation. The circuit includes: a VCOM driver configured to output alternating voltage levels at an output thereof, the output being connected to a display panel; a switching circuit with a plurality of inputs and an output, being configured to select one of voltage levels at the inputs at a time and thereby to output alternating voltages levels at the output of the switching circuit; and a stabilizing capacitor with one end connected to the output of the VCOM driver, and the other end connected to the output of the switching circuit.

The switching circuit may be configured to output voltage levels of 0, Vs1, and Vs2, where Vs2=−Vs1. The VCOM driver may be configured to output three alternating voltage levels Vcomc, Vcom1 and Vcom2 at the output thereof, where Vcom1=Vs1+Vcomc, Vcom2=Vs2+Vcomc. The VCOM driver may be configured to output two alternating states: Vcomc voltage level and high impedance state.

The switching circuit may include three MOS switches, source or drain of the three MOS switches being respectively connected to ground, power source of the voltage level Vs1, and power source of the voltage level Vs2; drain or source of the MOS switches being connected to the output of the switching circuit.

The VCOM driver may include three MOS switches, a first operational amplifier, and a second operational amplifier, source or drain of the three MOS switches being respectively connected to ground, power source of the voltage level Vs1, and power source of the voltage level Vs2; the drain or source of the three MOS switches being connected to an input of the second operational amplifier through a first resistor.

The first operational amplifier may be configured to output the voltage level Vcomc and the output of the first operational amplifier may be connected to the input of the second operational amplifier through a second resistor. The circuit may further include a MOS switch, source or drain of the MOS switch being connected to an output of the second operational amplifier; drain or source of the MOS switch being connected to the stabilizing capacitor.

The VCOM driver may include a first operational amplifier configured to output the voltage level Vcomc and a MOS switch, source or drain of the MOS switch being connected to an output of the first operational amplifier; drain or source of the MOS switch being connected to the stabilizing capacitor.

In yet another aspect, the present patent application provides a circuit for common electrode voltage generation. The circuit includes: a VCOM driver configured to output alternating voltage levels at an output thereof, the output being connected to a display panel; and a switching circuit with three inputs and an output, being configured to select one of voltage levels at the inputs at a time and thereby to output alternating voltages levels at the output of the switching circuit so that the voltage difference across a stabilizing capacitor is set to be close to a constant value Vcomc. One end of the stabilizing capacitor is connected to the output of the VCOM driver, and the other end of the stabilizing capacitor is connected to the output of the switching circuit. The switching circuit includes three MOS switches, source or drain of the three MOS switches being respectively connected to ground, power source of voltage level Vs1, and power source of voltage level Vs2; drain or source of the MOS switches being connected to the output of the switching circuit.

The VCOM driver may be configured to output three alternating voltage levels Vcomc, Vcom1 and Vcom2 at the output thereof, where Vcom1=Vs1+Vcomc, Vcom2=Vs2+Vcomc. The VCOM driver may include three MOS switches, a first operational amplifier, and a second operational amplifier, source or drain of the three MOS switches being respectively connected to ground, the power source of voltage level Vs1, and the power source of voltage level Vs2; the drain or source of the three MOS switches being connected to an input of the second operational amplifier through a first resistor.

The VCOM driver may be configured to output two alternating states: Vcomc voltage level and high impedance state. The VCOM driver may include a first operational amplifier configured to output the voltage level Vcomc and a MOS switch, source or drain of the MOS switch being connected to an output of the first operational amplifier; drain or source of the MOS switch being connected to the stabilizing capacitor.

BRIEF DESCRIPTIONS OF THE DRAWINGS

FIG. 1 is a schematic diagram of a display panel and electronic driving circuits of the display panel.

FIG. 2 is a schematic diagram of one display pixel of the display panel depicted in FIG. 1.

FIG. 3 shows a waveform of VCOM voltage in the AC-VCOM method.

DETAILED DESCRIPTION

Reference will now be made in detail to a preferred embodiment of the circuit for common electrode voltage generation disclosed in the present patent application, examples of which are also provided in the following description. Exemplary embodiments of the circuit disclosed in the present patent application are described in detail, although it will be apparent to those skilled in the relevant art that some features that are not particularly important to an understanding of the circuit may not be shown for the sake of clarity.

Furthermore, it should be understood that the circuit disclosed in the present patent application is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure.

Figure 4:
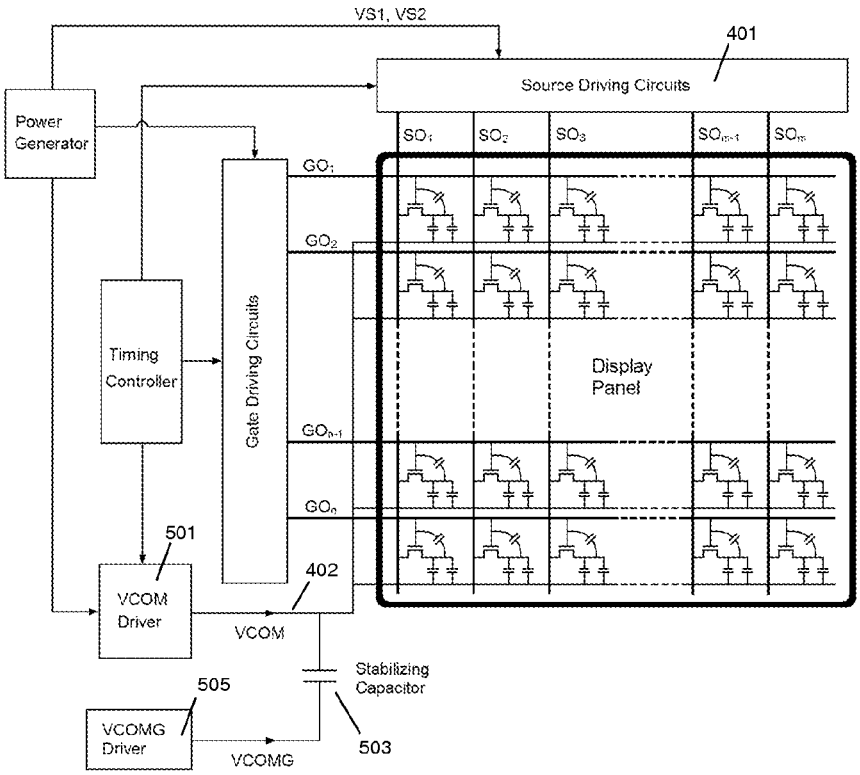
FIG. 4 is a schematic diagram of a display panel and electronic driving circuits of the display panel in accordance with an embodiment of the present patent application.
Figure 5:
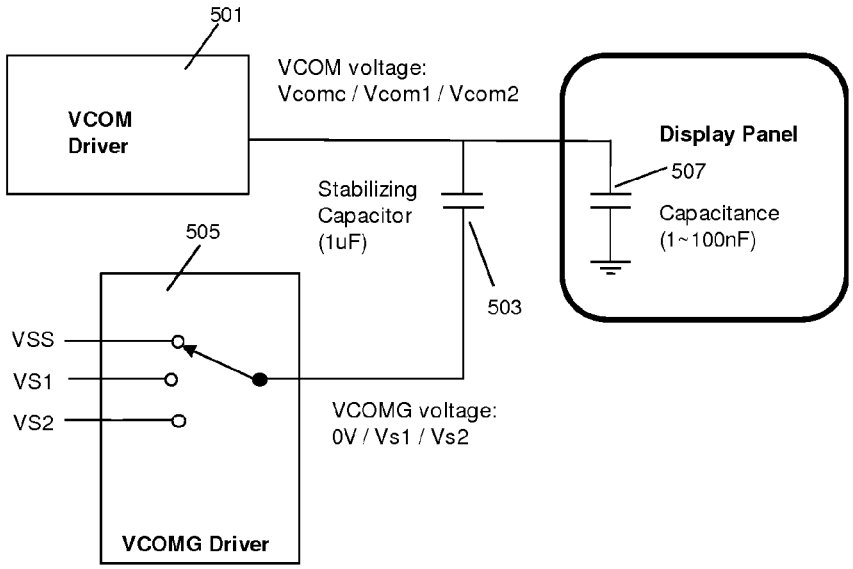
FIG. 5 shows a circuit for common electrode voltage generation in accordance with the embodiment depicted by FIG. 4.

FIG. 4 is a schematic diagram of a display panel and electronic driving circuits of the display panel in accordance with an embodiment of the present patent application. FIG. 5 shows a circuit for common electrode voltage generation in accordance with the embodiment depicted by FIG. 4. Referring to FIGS. 4 and 5, the circuit for common electrode voltage generation includes a VCOM driver 501, a stabilizing capacitor 503, and a VCOMG driver 505. One end of the stabilizing capacitor 503 is connected to the output of the VCOM driver, while the other end of the stabilizing capacitor 503 is connected to the output of the VCOMG driver 505. The output of the VCOM driver is also connected to the VCOM electrode 402 of the display panel. The display panel is modeled as a capacitor 507. The VCOMG driver 505 is a voltage driving circuit to output alternating voltage levels following the alternating voltage levels of VCOM (i.e. output of the VCOM driver 501) so that the charging and discharge of the stabilizing capacitor 503 is minimized. It may be implemented as a switching circuit as shown in FIG. 5. The inputs of the switching circuit are connected to the voltage sources of the desired VCOMG output voltage levels. In this embodiment, the VCOMG voltage levels are VSS, Vs1 and Vs2, where VSS is 0V, Vs1 is the voltage value of VS1, and Vs2 is the voltage value of VS2. These levels follow the VCOM voltage levels, and they are voltage levels of source driving circuits 401. Hence, these voltage sources are readily available in the system and no additional power generator circuit is required for the VCOMG driver 505.

In this embodiment, the switching circuit has three inputs, however, it is understood that in another embodiment, the switching circuit may have more than three inputs as long as the switching circuit is configured to output alternating voltage levels following the alternating voltage levels of VCOM (i.e. output of the VCOM driver 501) so that the charging and discharge of the stabilizing capacitor 503 is minimized.

More specifically, in this embodiment, the VCOM driver is configured to output voltage (i.e. the VCOM voltage) alternating between Vcomc (−2V), Vcom1 (13V) and Vcom2 (−17V). When the VCOM voltage needs to be driven to Vcomc, VCOMG is driven to VSS (0V); when the VCOM voltage needs to be driven to Vcom1, VCOMG is driven to Vs1; when the VCOM voltage needs to be driven to Vcom2, VCOMG is driven to Vs2.

Figure 6:
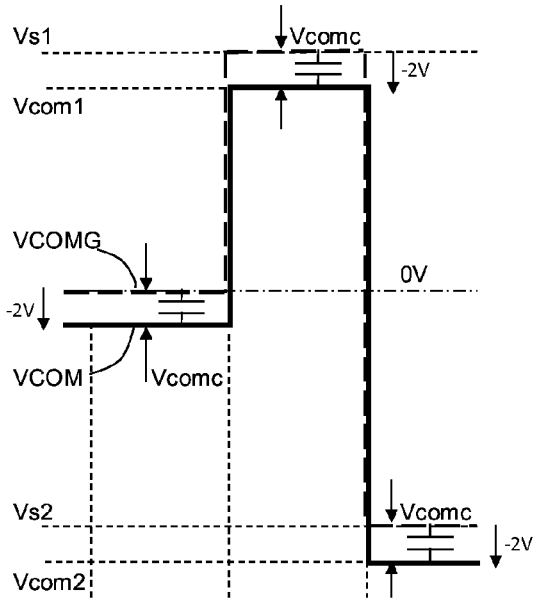
FIG. 6 shows waveforms of the VCOM voltage and the VCOMG voltage in accordance with an embodiment of the present patent application.

FIG. 6 shows waveforms of the VCOM voltage and the VCOMG voltage in accordance with an embodiment of the present patent application. Referring to FIG. 6, when VCOM=Vcomc=−2V, VCOMG=0, the voltage across the stabilizing capacitor 503 (as shown in FIGS. 4 and 5) is Vcomc=−2V; when VCOM=Vcom1=Vs1+Vcomc=15V−2V=13V, VCOMG=Vs1=15V, the voltage across the stabilizing capacitor 503 is Vcomc=−2V; when VCOM=Vcom2=Vs2+Vcomc=−15V−2V=−17V, VCOMG=Vs2=−15V, the voltage across the stabilizing capacitor 503 is Vcomc=−2V. It is shown that while VCOM alternates between Vcomc (−2V), Vcom1 (13V) and Vcom2 (−17V), the voltage across the stabilizing capacitor 503 remains constant (−2V). Hence, with this circuit, repeated charging and discharging the stabilizing capacitor 503 is avoided and power consumption of the circuit is thereby reduced.

Figure 7A:
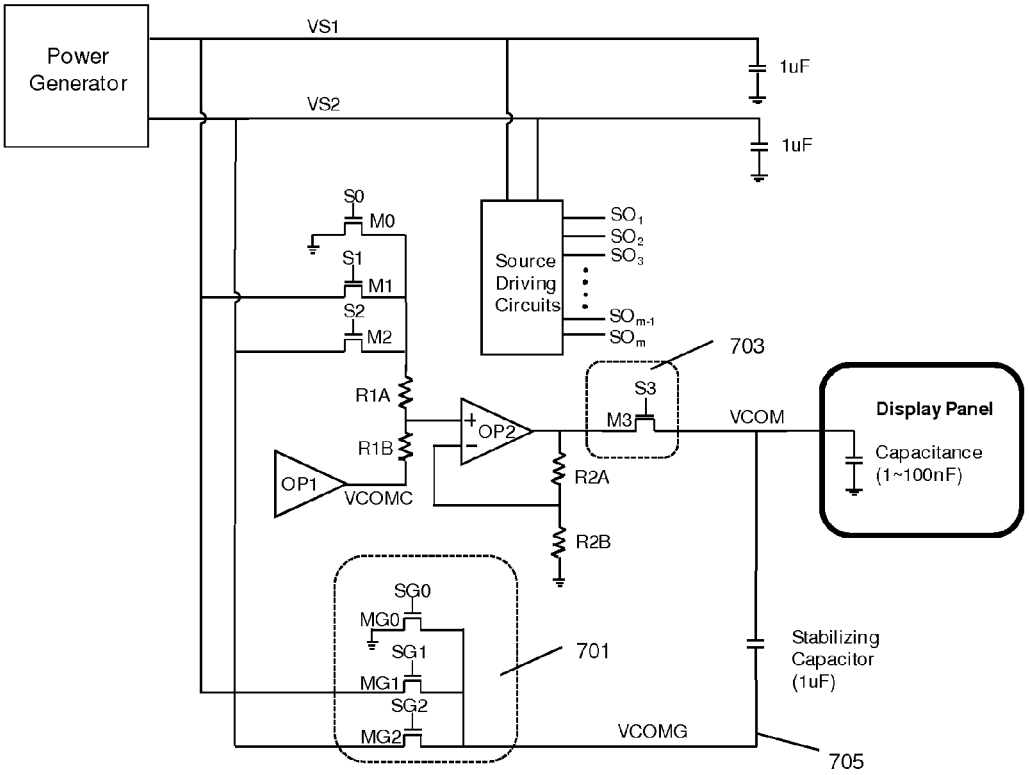
FIG. 7A is a schematic diagram of a circuit for common electrode voltage generation in accordance with an embodiment of the present patent application.

FIG. 7A is a schematic diagram of a circuit for common electrode voltage generation in accordance with an embodiment of the present patent application. Referring to FIG. 7A, VCOMG driver 505 in FIG. 5 is implemented by three MOS switches, as illustrated by the block 701. More specifically, MOS MG0 is employed with source or drain terminal connected to the ground, with drain or source terminal connected to the VCOMG driver output 705. MOS MG1 is employed with source or drain terminal connected to VS1 power source, with drain or source terminal connected to the VCOMG driver output 705. MOS MG2 is employed with source or drain terminal connected to VS2 power source, with drain or source terminal connected to the VCOMG driver output 705.

Referring to FIG. 7A, the circuit includes three MOS switches M0, M1 and M2, a first operational amplifier OP1, and a second operational amplifier OP2. The source or drain of the three MOS switches M0, M1 and M2 is connected to the ground, VS1, VS2 power sources respectively, while the drain or source of the three MOS switches M0, M1 and M2 is connected to an input of the operational amplifier OP2 through the resistor R1A. The first operational amplifier OP1 is configured to output the voltage level Vcomc at its output and the output of OP1 is connected to the input of the operational amplifier OP2 through the resistor R1B.

As illustrated by the block 703, the circuit includes a MOS M3, which is employed with source or drain terminal connected to the output of OP2, and with drain or source terminal connected to VCOM driver output.

Figure 7B:
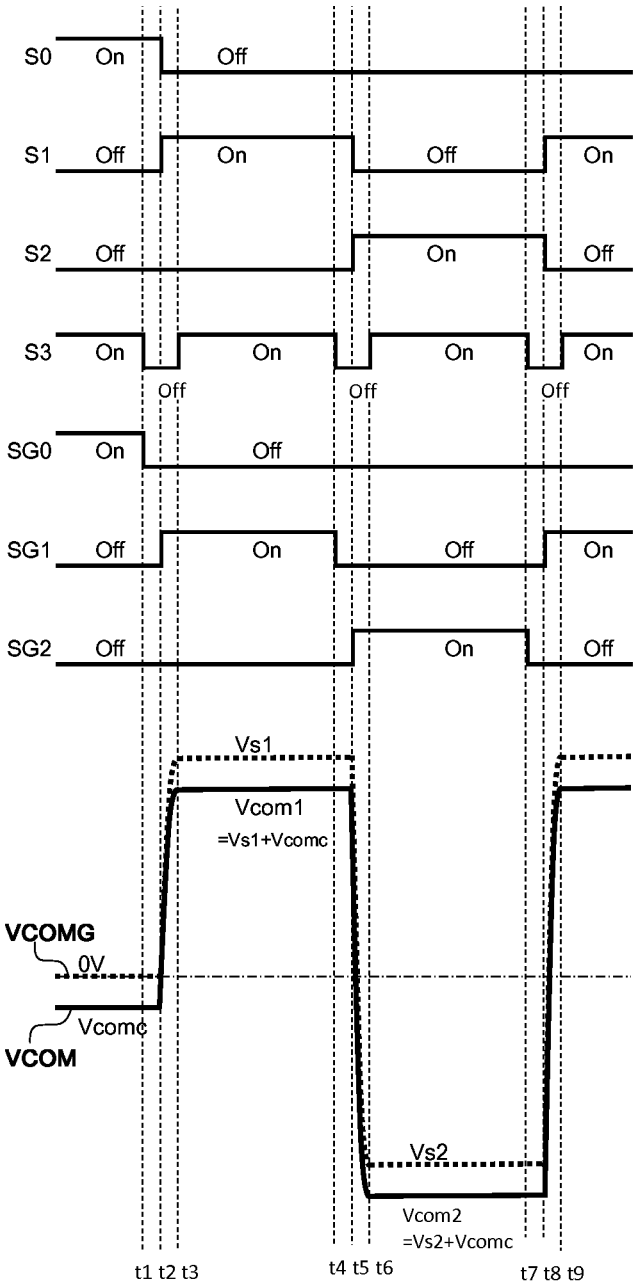
FIG. 7B is a timing diagram illustrating an operation example of the circuit depicted in FIG. 7A.

FIG. 7B is a timing diagram illustrating an operation example of the circuit depicted in FIG. 7A. Referring to FIG. 7A and FIG. 7B, before time t1, M0 and M3 are turned on, M1 and M2 are turned off, hence the VCOM driver output is driven by OP2, and the voltage level is Vcomc; at the same time, MG0 is turned on, MG1 and MG2 are turned off, hence VCOMG driver output 705 is driven by ground (0V). At the time between t1 and t2, M3, MG0, MG1, and MG2 are turned off, hence, both VCOM and VCOMG output are high impedance, the voltage on VCOM and VCOMG are kept the same as the previous level. This time period is for non-overlapping to avoid short circuit between powers or signals. At the time between t2 and t3, M3, MG0, and MG2 are turned off, MG1 is turned on, hence, VCOMG is driven by VS1 power and it rises from 0V to Vs1. At the same time, VCOM is driven by the stabilizing capacitor and it rises from Vcomc to a voltage level close to Vcom1. At the time between t3 and t4, M1 and M3 are turned on, M0 and M2 are turned off, hence the VCOM driver output is driven by OP2 and the voltage settles to the accurate level of Vcom1; at the same time, MG1 is turned on, MG0 and MG2 are turned off, hence, the VCOMG driver output 705 is kept driven to Vs1. At the time between t4 and t5, M3, MG0, MG1, and MG2 are turned off, hence, both VCOM and VCOMG output are high impedance, the voltages on VCOM and VCOMG are kept the same as previous level. This time period is for non-overlapping to avoid short circuit between powers or signals. At the time between t5 and t6, M3, MG0, and MG1 are turned off, MG2 is turned on, hence, VCOMG is driven by VS2 power and it falls from Vs1 to Vs2. At the same time, VCOM is driven by the stabilizing capacitor and it falls from Vcom1 to a voltage level close to Vcom2. At the time between t6 and t7, M2 and M3 are turned on, M0 and M1 are turned off, hence the VCOM driver output is driven by OP2 and the voltage settles to the accurate level of Vcom2; at the same time, MG2 is turned on, MG0 and MG1 are turned off, hence VCOMG driver output 705 is kept driven to Vs2.

In this embodiment, the VCOM waveform generated by the circuit is the same as the conventional AC-VCOM method, but the circuit has the advantage of keeping the voltage across the stabilizing capacitor constant, which leads to lower power consumption and thus longer battery life in applications; less peak transient current and thus only a small power supply or battery is required; shorter settling time and thus closer to the ideal driving waveform, and negative effects on the display quality is reduced; and shorter settling time and thus higher display refresh frame frequency is possible.

Figure 8A:
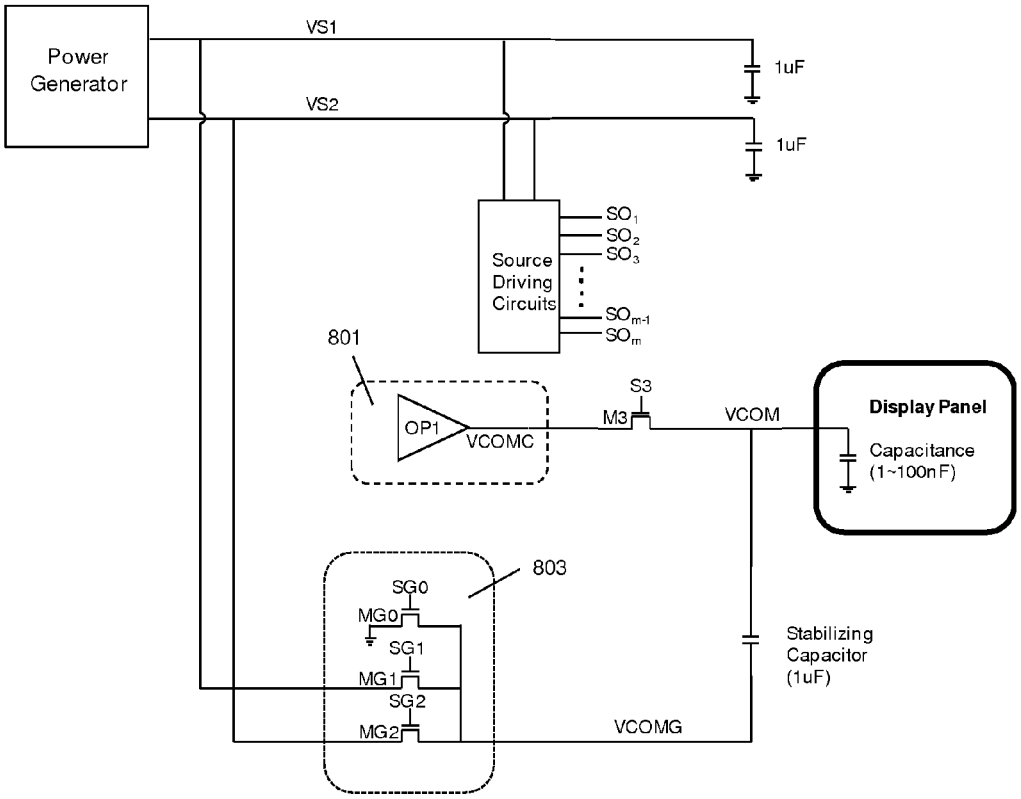
FIG. 8A is a schematic diagram of a circuit for common electrode voltage generation in accordance with another embodiment of the present patent application.

FIG. 8A is a schematic diagram of a circuit for common electrode voltage generation in accordance with another embodiment of the present patent application. Referring to FIG. 8A, compared with the embodiment in FIG. 7A, in this embodiment, switch elements M0, M1 and M2 are removed. High-voltage operational amplifier OP2 is removed. The output of the low-voltage VCOMC generator, i.e. operational amplifier OP1, shown as the block 801, is connected to the source or drain of the MOS switch M3, while the drain or source of the MOS switch M3 is connected to the VCOM driver output and the stabilizing capacitor.

Figure 8B:
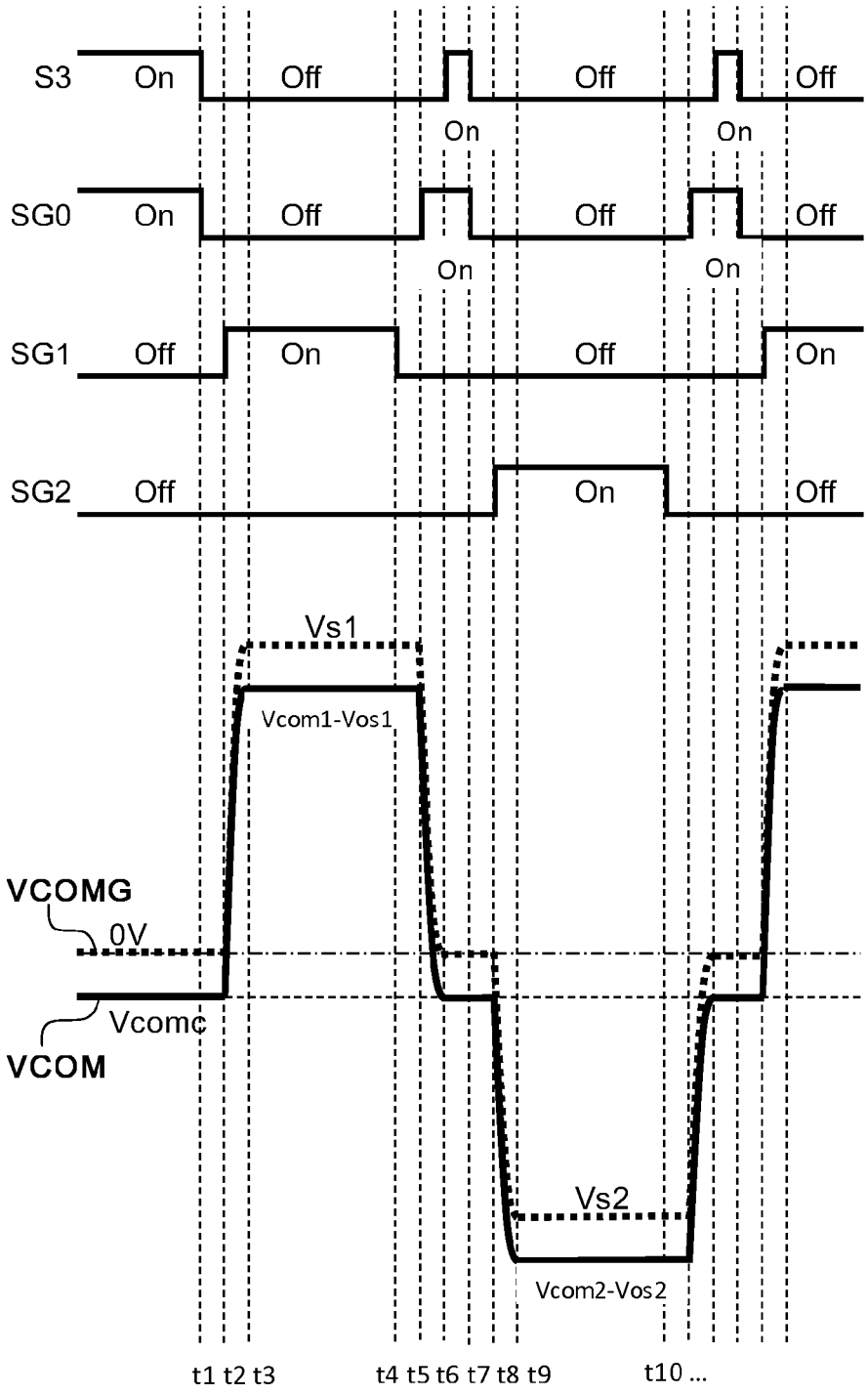
FIG. 8B is a timing diagram illustrating an operation example of the circuit depicted in FIG. 8A.

FIG. 8B is a timing diagram illustrating an operation example of the circuit depicted in FIG. 8A. Referring to FIG. 8A and FIG. 8B, before time t1, M3 is turned on, hence the VCOM driver output is driven by OP1, and the voltage level is Vcomc; at the same time, MG0 is turned on, MG1 and MG2 are turned off, hence VCOMG driver output is driven by ground (0V). At the time between t1 and t2, M3, MG0, MG1, and MG2 are all turned off, hence, both VCOM and VCOMG driver outputs are high impedance, the voltage on VCOM and VCOMG are kept the same as the previous levels. This time period is for non-overlapping to avoid short circuit between powers or signals. At the time between t2 and t4, M3, MG0, and MG2 are turned off, MG1 is turned on, hence, VCOMG is driven by VS1 power and it rises from 0V to Vs1. At the same time, VCOM is driven by the stabilizing capacitor and it rises from Vcomc to the voltage level of Vcom1−Vos1, where Vos1 is a small offset voltage due to charge sharing between VCOM stabilizing capacitor and the panel capacitor. At the time between t4 and t5, M3, MG0, MG1, and MG2 are all turned off, hence, both VCOM and VCOMG outputs are high impedance, the voltage on VCOM and VCOMG are kept the same as the previous levels. This time period is for non-overlapping between the toggling of control signals. At the time between t5 and t6, MG0 is turned on, M3, MG1 and MG2 are turned off, and hence the VCOMG driver output is discharged from Vs1 to 0V at this time period. At the same time, VCOM is driven by the stabilizing capacitor and it falls from Vcom1−Vos1 to a voltage level close to Vcomc. At the time between t6 and t7, M3 and MG0 are turned on, MG1 and MG2 are turned off, hence, the VCOM driver output is driven by OP1 and the voltage settles to the accurate level of Vcomc. The purpose of the operation in this time period is to recharge the stabilizing capacitor before VCOM toggling from Vcom1 to Vcom2. For VCOM toggling from Vcom2 to Vcom1, similar operation can be conducted to recharge the stabilizing capacitor. At the time between t7 and t8, M3, MG0, MG1, and MG2 are all turned off, hence, both VCOM and VCOMG output are high impedance, the voltage on VCOM and VCOMG are kept the same as the previous levels. This time period is for non-overlapping to avoid short circuit between powers or signals. At the time between t8 and t10, M3, MG0, and MG1 are turned off, MG2 is turned on, hence, VCOMG is driven by VS2 power and it falls from 0V to Vs2. At the same time, VCOM is driven by the stabilizing capacitor and it falls from Vcomc to the voltage level of Vcom2−Vos2, where Vos2 is the small offset voltage due to charge sharing between stabilizing capacitor and the panel capacitor.

In this embodiment, the VCOM driver is configured to output only 2 states during a display period: the Vcomc voltage level and high impedance state. The resultant VCOM waveform (as shown in FIG. 8B) is close to the waveform of the embodiment in FIG. 7B. The small offset voltages Vos1 and Vos2 depend on the ratio between panel capacitance and stabilizing capacitance. A large enough stabilizing capacitor can reduce the offset voltage to a small value so that the display quality will not be affected. In this embodiment, the VCOM Driver is not required to output high voltage levels of Vcom1 and Vcom2. Therefore, the circuit is simplified compared to the embodiment in FIG. 7A, and only low voltage device components are used (except for the VCOMG driver 803 as shown in FIG. 8A), which results in silicon area reduction, manufacturing cost reduction and further reduction of power consumption.

While the present patent application has been shown and described with particular references to a number of embodiments thereof, it should be noted that various other changes or modifications may be made without departing from the scope of the present invention.

What is claimed is:

1. A circuit for common electrode voltage generation, the circuit comprising:
- a VCOM driver configured to output alternating voltage levels at an output thereof, the output being connected to a display panel;
- a switching circuit with three inputs and an output, being configured to select one of voltage levels at the inputs at a time and thereby to output alternating voltages levels at the output of the switching circuit; and
- a stabilizing capacitor with one end connected to the output of the VCOM driver, and the other end connected to the output of the switching circuit; wherein:
- the switching circuit is configured to output voltage levels of 0, Vs1, and Vs2, where Vs2=−Vs1; and
- the VCOM driver is configured to output three alternating voltage levels Vcomc, Vcom1 and Vcom2 at the output thereof, where Vcom1=Vs1+Vcomc, Vcom2=Vs2+Vcomc, or to output two alternating states: Vcomc voltage level and high impedance state;
- wherein the switching circuit comprises three MOS switches, source or drain of the three MOS switches of the switching circuit being respectively connected to ground, power source of the voltage level Vs1, and power source of the voltage level Vs2; drain or source of the MOS switches being connected to the output of the switching circuit.

2. The circuit of claim 1, wherein the VCOM driver comprises three MOS switches, a first operational amplifier, and a second operational amplifier, source or drain of the three MOS switches of the VCOM driver being respectively connected to ground, power source of the voltage level Vs1, and power source of the voltage level Vs2; the drain or source of the three MOS switches of the VCOM driver being connected to an input of the second operational amplifier through a first resistor.

3. The circuit of claim 2, wherein the first operational amplifier is configured to output the voltage level Vcomc and the output of the first operational amplifier is connected to the input of the second operational amplifier through a second resistor.

4. The circuit of claim 3 further comprising a MOS switch, source or drain of the MOS switch being connected to an output of the second operational amplifier; drain or source of the MOS switch being connected to the stabilizing capacitor.

5. The circuit of claim 1, wherein the VCOM driver comprises a first operational amplifier configured to output the voltage level Vcomc and a MOS switch, source or drain of the MOS switch being connected to an output of the first operational amplifier; drain or source of the MOS switch being connected to the stabilizing capacitor.

6. A circuit for common electrode voltage generation, the circuit comprising:
- a VCOM driver configured to output alternating voltage levels at an output thereof, the output being connected to a display panel;
- a switching circuit with a plurality of inputs and an output, being configured to select one of voltage levels at the inputs at a time and thereby to output alternating voltages levels at the output of the switching circuit; and a stabilizing capacitor with one end connected to the output of the VCOM driver, and the other end connected to the output of the switching circuit;

wherein the switching circuit is configured to output voltage levels of 0, Vs1, and Vs2, where Vs2=−Vs1;

wherein the VCOM driver is configured to output two alternating states: Vcomc voltage level and high impedance state; and wherein the VCOM driver comprises a first operational amplifier configured to output the voltage level Vcomc and a MOS switch, source or drain of the MOS switch being connected to an output of the first operational amplifier; drain or source of the MOS switch being connected to the stabilizing capacitor.

7. The circuit of claim 6, wherein the VCOM driver is configured to output three alternating voltage levels Vcomc, Vcom1 and Vcom2 at the output thereof, where Vcom1=Vs1+Vcomc, Vcom2=Vs2+Vcomc.

8. The circuit of claim 6, wherein the switching circuit comprises three MOS switches, source or drain of the three MOS switches being respectively connected to ground, power source of the voltage level Vs1, and power source of the voltage level Vs2; drain or source of the MOS switches being connected to the output of the switching circuit.

9. The circuit of claim 7, wherein the VCOM driver comprises three MOS switches, a first operational amplifier, and a second operational amplifier, source or drain of the three MOS switches being respectively connected to ground, power source of the voltage level Vs1, and power source of the voltage level Vs2; the drain or source of the three MOS switches being connected to an input of the second operational amplifier through a first resistor.

10. The circuit of claim 9, wherein the first operational amplifier is configured to output the voltage level Vcomc and the output of the first operational amplifier is connected to the input of the second operational amplifier through a second resistor.

11. The circuit of claim 10 further comprising a MOS switch, source or drain of the MOS switch being connected to an output of the second operational amplifier; drain or source of the MOS switch being connected to the stabilizing capacitor.

12. A circuit for common electrode voltage generation, the circuit comprising:

a VCOM driver configured to output alternating voltage levels at an output thereof, the output being connected to a display panel; and a switching circuit with three inputs and an output, being configured to select one of voltage levels at the inputs at a time and thereby to output alternating voltages levels at the output of the switching circuit so that the voltage difference across a stabilizing capacitor is set to be close to a constant value Vcomc; wherein:

one end of the stabilizing capacitor is connected to the output of the VCOM driver, and the other end of the stabilizing capacitor is connected to the output of the switching circuit; and the switching circuit comprises three MOS switches, source or drain of the three MOS switches being respectively connected to ground, power source of voltage level Vs1, and power source of voltage level Vs2; drain or source of the MOS switches being connected to the output of the switching circuit.

13. The circuit of claim 12, wherein the VCOM driver is configured to output three alternating voltage levels Vcomc, Vcom1 and Vcom2 at the output thereof, where Vcom1=Vs1+Vcomc, Vcom2=Vs2+Vcomc.

14. The circuit of claim 13, wherein the VCOM driver comprises three MOS switches, a first operational amplifier, and a second operational amplifier, source or drain of the three MOS switches being respectively connected to ground, the power source of voltage level Vs1, and the power source of voltage level Vs2; the drain or source of the three MOS switches being connected to an input of the second operational amplifier through a first resistor.

15. The circuit of claim 12, wherein the VCOM driver is configured to output two alternating states: Vcomc voltage level and high impedance state.

16. The circuit of claim 15, wherein the VCOM driver comprises a first operational amplifier configured to output the voltage level Vcomc and a MOS switch, source or drain of the MOS switch being connected to an output of the first operational amplifier; drain or source of the MOS switch being connected to the stabilizing capacitor.

* * * * *